US006116328A

United States Patent [19]

Karmarkar et al.

[11] Patent Number: 6,116,328

[45] Date of Patent: Sep. 12, 2000

[54] FABRICATION OF TILE REINFORCED COMPOSITE ARMOR CASTING

[75] Inventors: Subhash D. Karmarkar, Great Falls; Amarnath P. Divecha, Falls Church, both of Va.; William J. Bruchey, Port Deposit; Gerald Bulmash, Street, both of Md.; James M. Kerr, Ashburn; William A. Ferrando, Arlington, both of Va.

[73] Assignee: The United States of America as represented by the Secretary of the Navy, Washington, D.C.

[21] Appl. No.: 09/362,883

[22] Filed: Jul. 29, 1999

[51] Int. Cl.[7] ..... B22D 19/02; B22D 13/00

[52] U.S. Cl. ..... 164/100; 164/111; 164/112; 164/98; 164/75; 164/114

[58] Field of Search ..... 164/100, 112, 164/114, 97, 98, 75, 111

[56] References Cited

U.S. PATENT DOCUMENTS

| | | | |
|---|---|---|---|
| 232,476 | 9/1880 | Ellis | 164/111 |
| 3,386,717 | 6/1968 | Foster et al. | 266/103 |
| 3,953,247 | 4/1976 | Elhaus et al. | 148/13 |
| 4,599,772 | 7/1986 | Graham | 29/156.5 R |
| 4,628,984 | 12/1986 | Noble | 164/33 |
| 4,763,717 | 8/1988 | Lajoye | 164/258 |
| 4,958,763 | 9/1990 | Divecha et al. | 228/193 |
| 5,223,278 | 6/1993 | Nicetto . | |
| 5,337,803 | 8/1994 | Divecha et al. | 164/98 |
| 5,509,459 | 4/1996 | Divecha et al. | 164/98 |

*Primary Examiner*—Harold Pyon
*Assistant Examiner*—I.-H. Lin
*Attorney, Agent, or Firm*—John Forrest; Jacob Shuster

[57] ABSTRACT

Alumina tiles within aluminum framing jigs are fixedly positioned by lock pins within an internally coated mold for centrifugal casting within a block of an aluminum alloy material. Such jigs and the tiles framed therein are coated with silver before casting to prevent aluminum oxidation by heating of the aluminum material to a molten state for deposit into the mold. Bonding of the tiles and framing of the jigs with the aluminum material being cast is also enhanced by such silver coating.

7 Claims, 7 Drawing Sheets

FABRICATION OF TILE REINFORCED COMPOSITE ARMOR CASTING

The present invention relates in general to the casting of a composite, tile reinforced metallic product such as aluminum armor.

BACKGROUND OF THE INVENTION

Aluminum armor reinforced by commercially available alumina tiles is presently fabricated by a relatively slow and costly process, which involves precise cutting of the tiles to size, accurate placement of such tiles within an aluminum block that is carefully machined in accordance with the tile configuration. The block then undergoes closing and/or welding before final machining to size. Such fabricating process is laborious, time consuming and costly.

Various relevant prior art techniques are available, involving centrifugal casting, coating of aluminum and casting molds, as well as heat treatment of aluminum and reinforcement thereof. Such prior art does not however teach or suggest elimination of cut, set and welding aspects of prior fabrication methods. It is therefore an important object of the present invention to provide a more rapid and less costly method of fabricating tile reinforced composite metal armor.

SUMMARY OF THE INVENTION

In accordance with the present invention, alumina tile as reinforcement for aluminum armor or the like is initially assembled within jigs formed by aluminum framing through which the tiles are fixedly positioned within a centrifugal casting mold that is coated with aluminum oxide as a release agent to facilitate its removal from an aluminum casting therein embodying the tile loaded jigs. Such jigs loaded with the tile are positioned within the casting mold and are coated with silver to prevent aluminum oxidation and enhance jig framing and tile bonding to the aluminum material being centrifugally cast after heating thereof to a molten state within the mold.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

Figure 1:
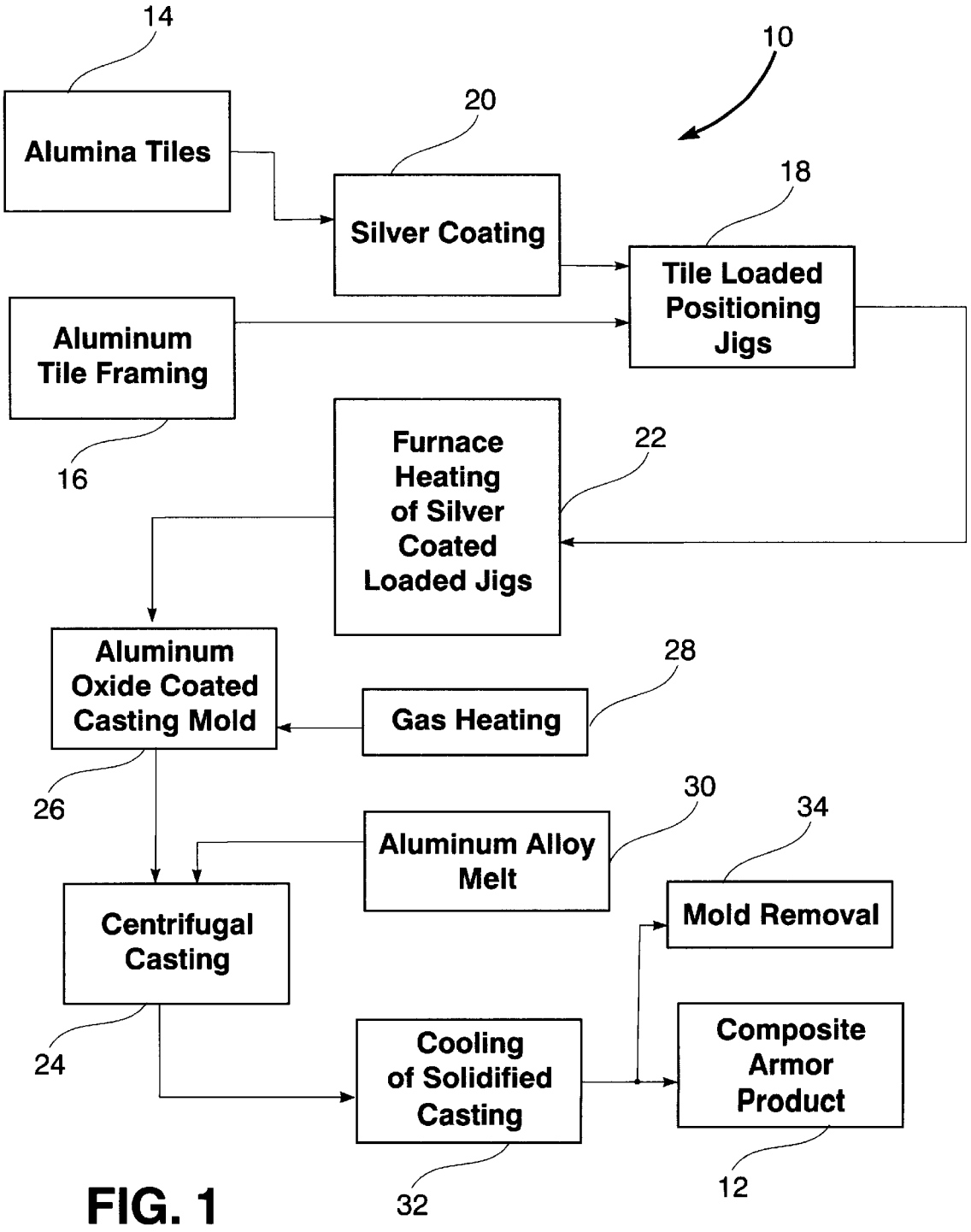
FIG. 1 is a block diagram depicting the composite armor fabrication process of the present invention.
Figure 3:
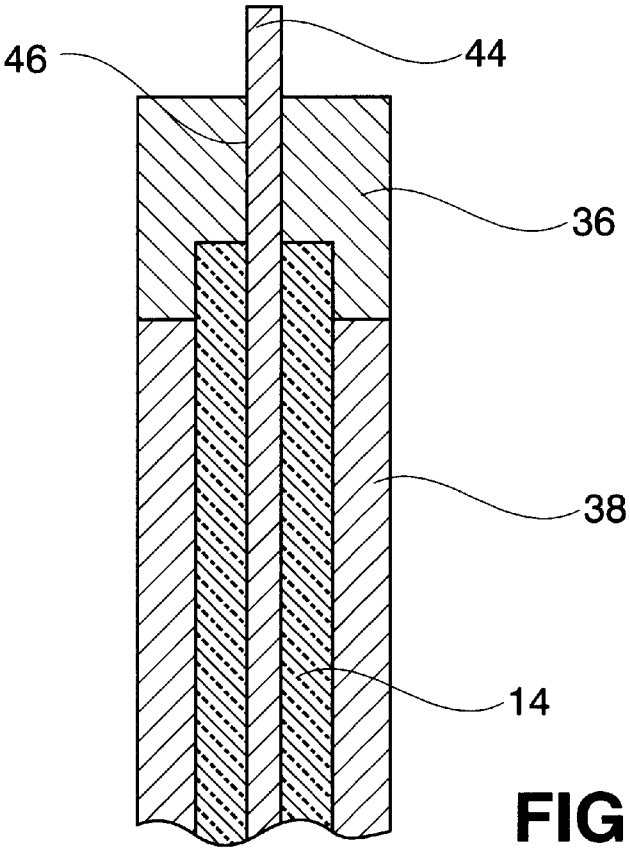
Figure 2:
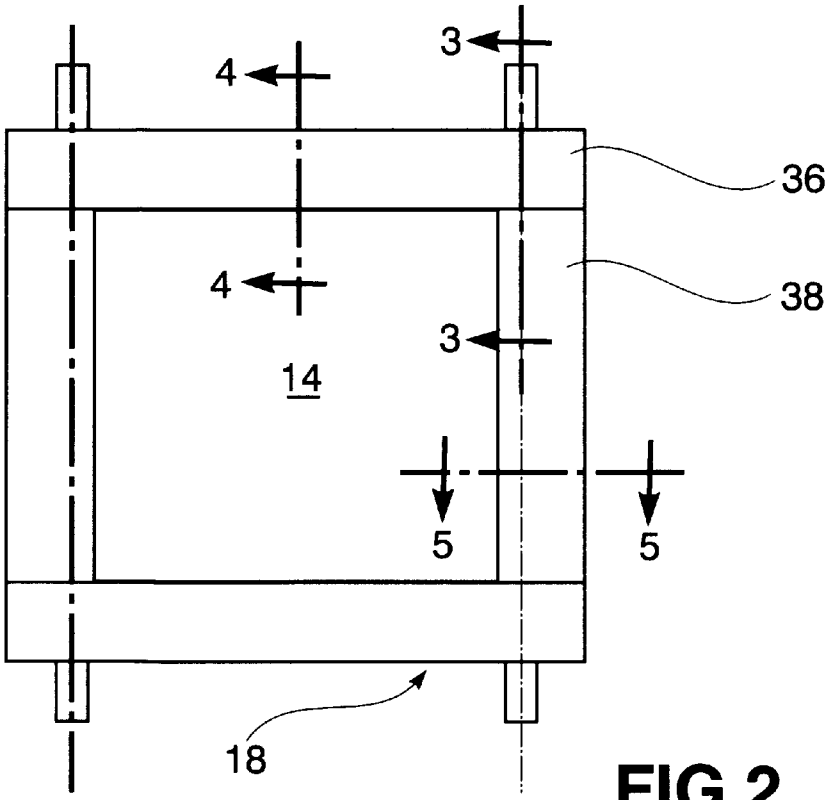
FIG. 2 is a top plan view of a tile framing jig arrangement for use as reinforcement of the composite armor undergoing the fabrication process depicted in FIG. 1.
Figure 5:
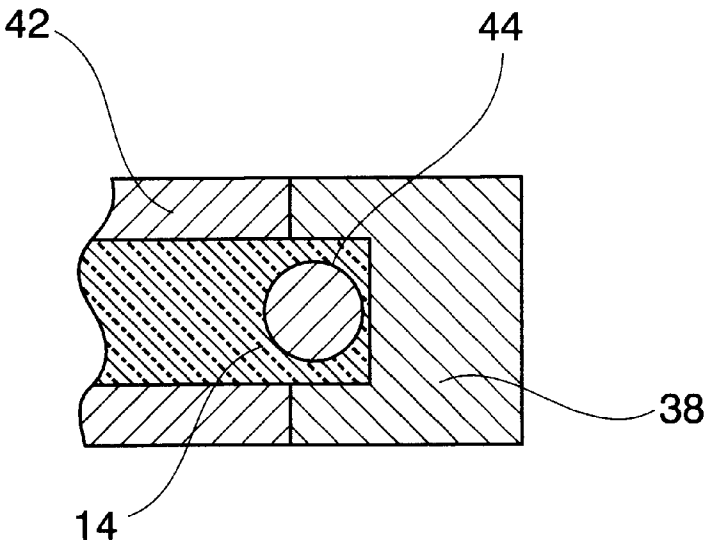
Figure 4:
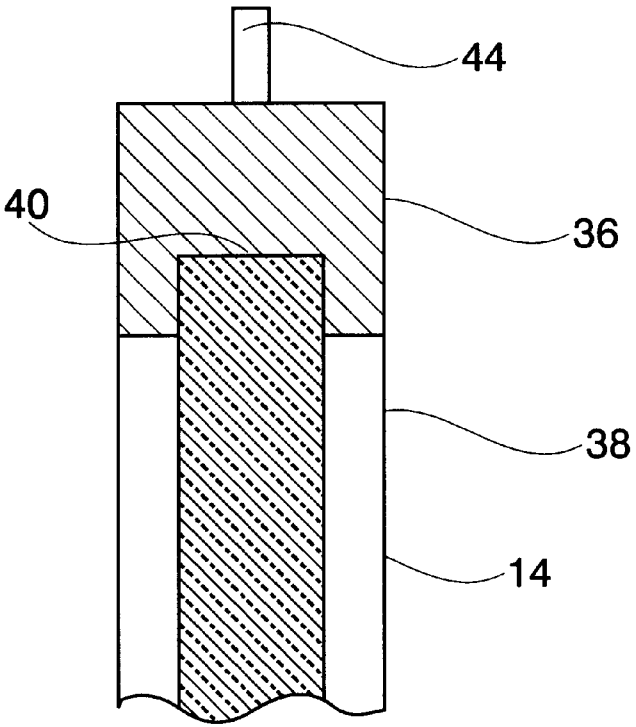
Figure 6:
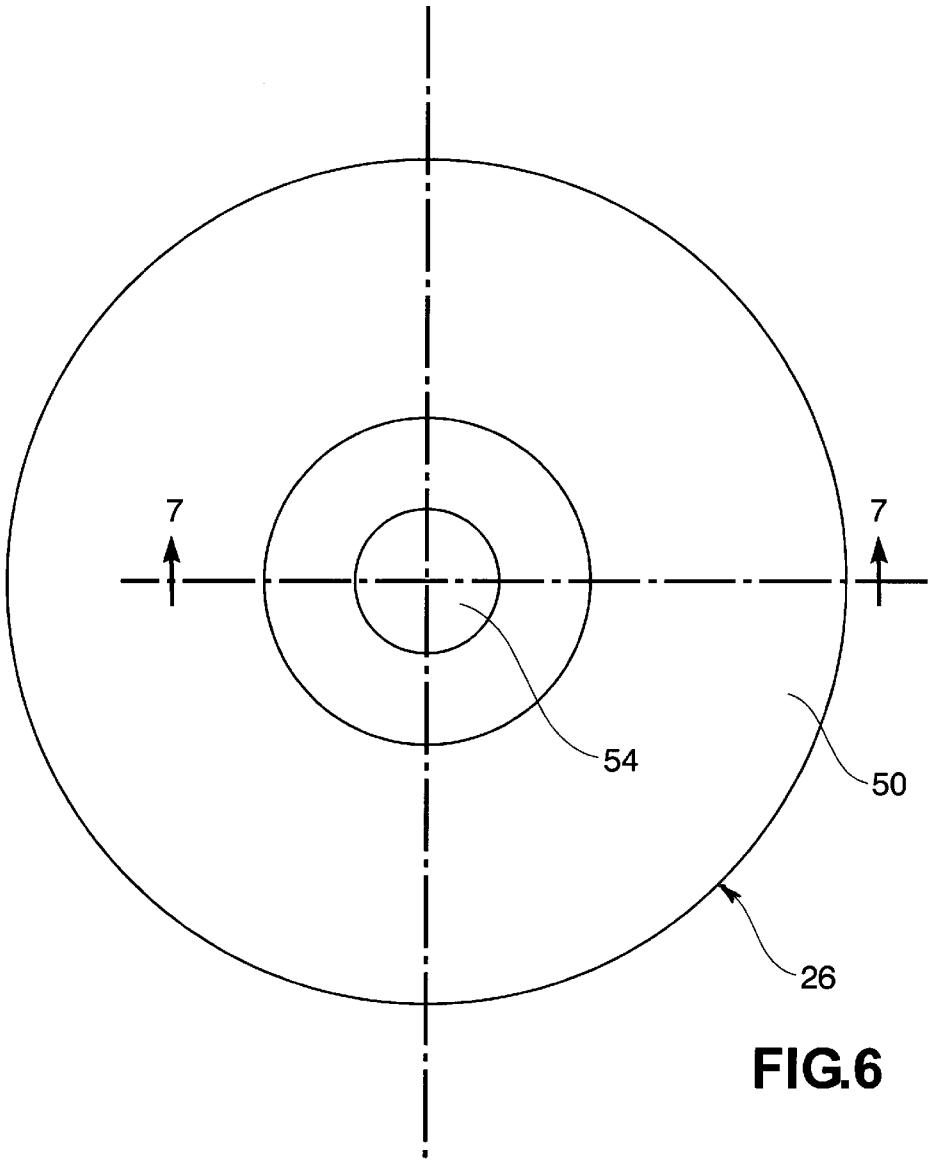
Figure 7:
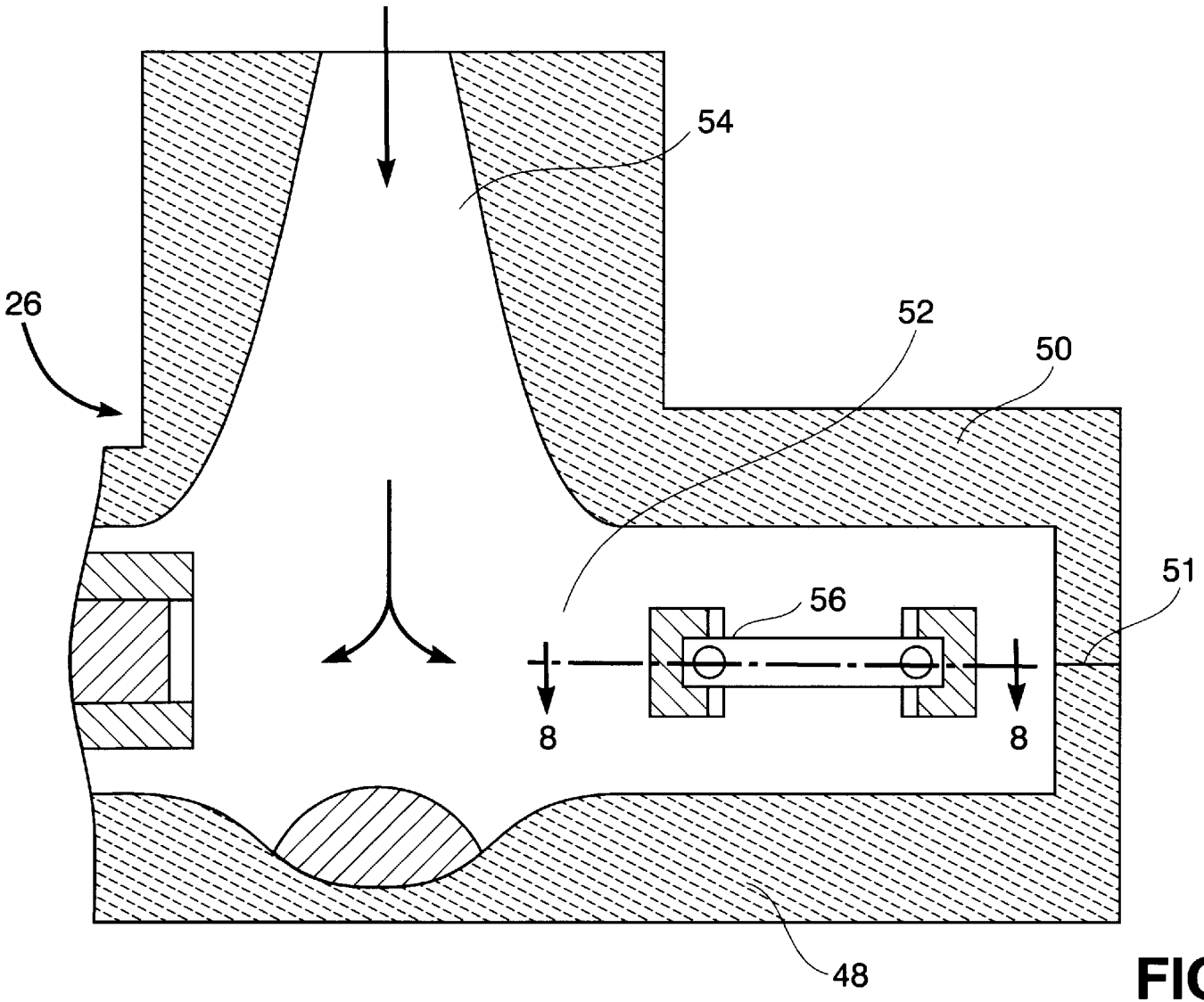
Figure 8:
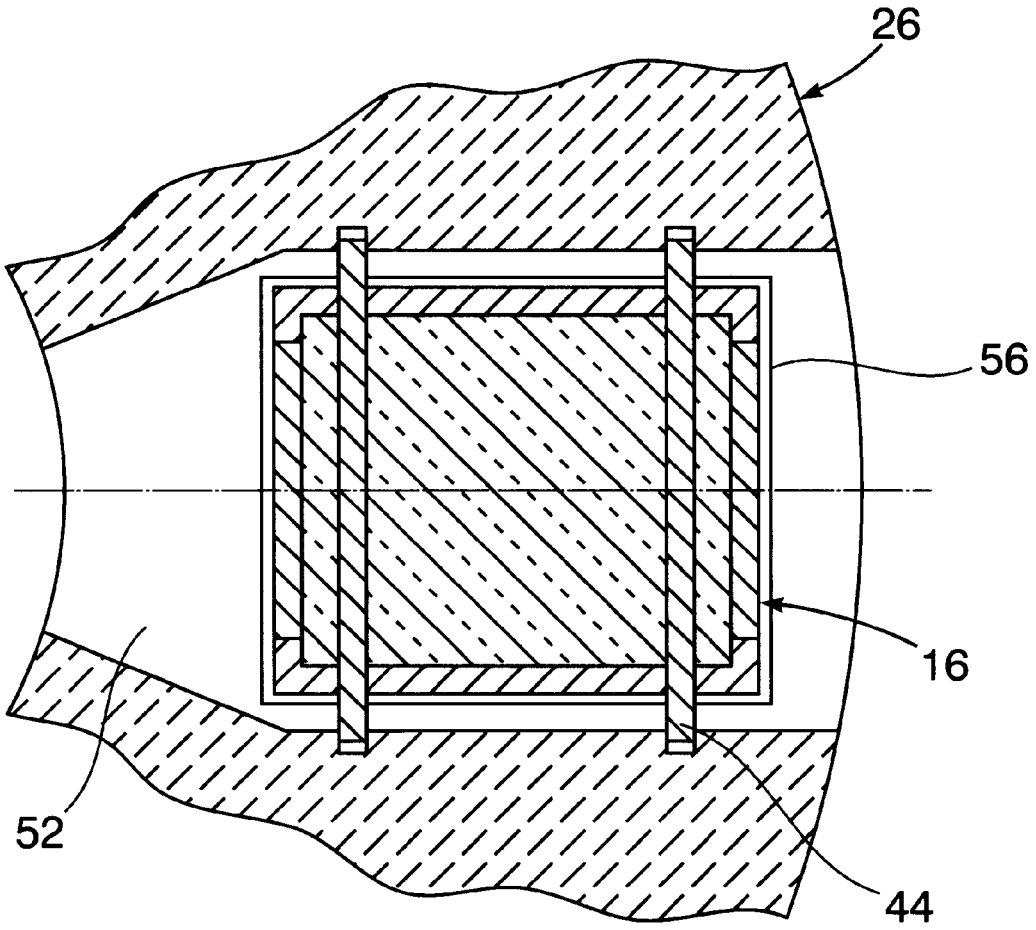
Figure 9:
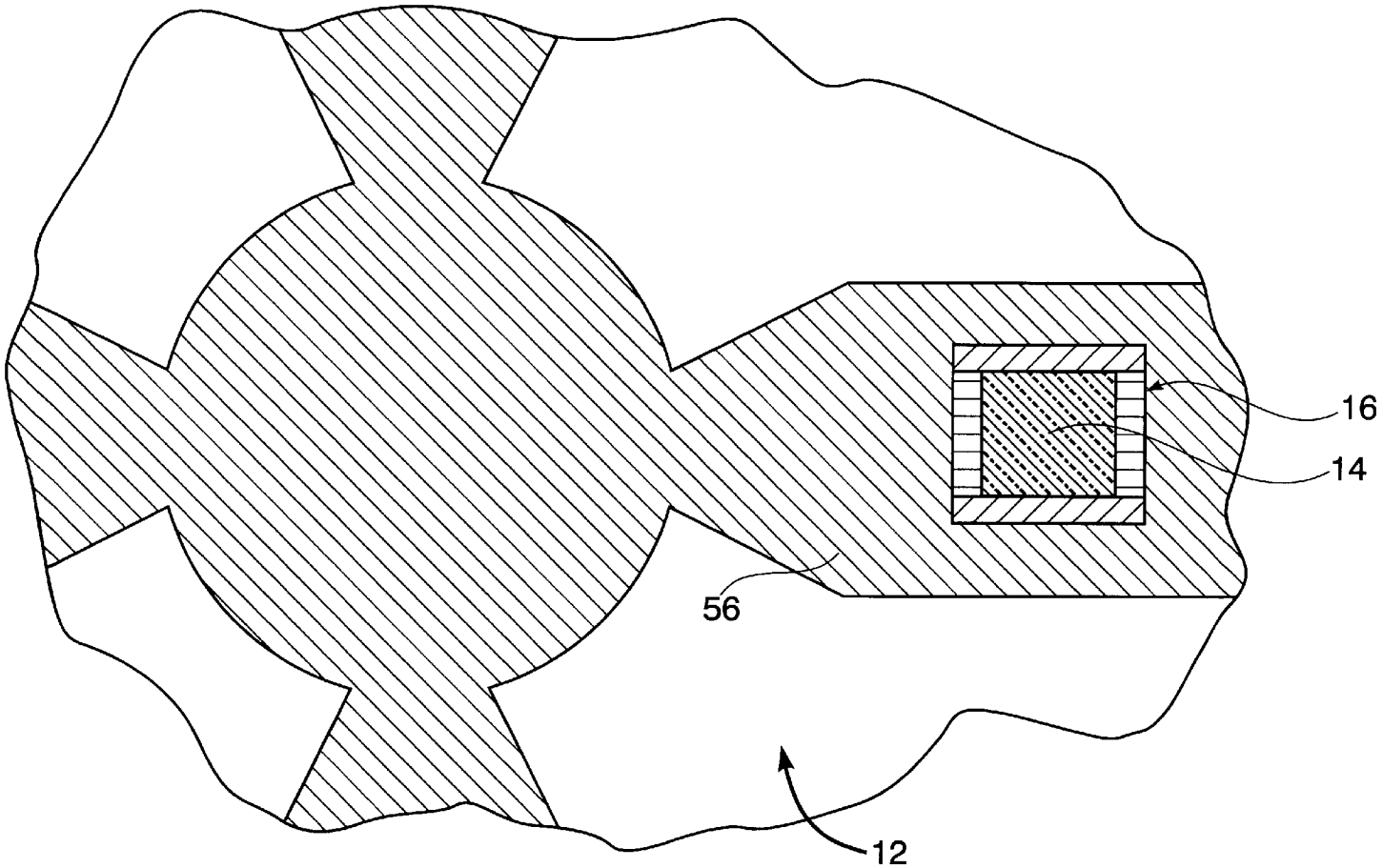

FIGS. 3, 4, and 5 are partial section views taken substantially through planes indicated by section lines 3—3, 4—4 and 5—5 in FIG. 2;

FIG. 6 is a top plan view of a centrifugal casting mold device having tile-loaded jigs positioned therein for use in the fabrication process diagrammed in FIG. 1;

FIG. 7 is a partial section view taken substantially through a plane indicated by section line 7—7 in FIG. 6;

FIG. 8 is a partial section view taken substantially through a plane indicated by section line 8—8 in FIG. 7; and FIG. 9 is a partial section view through a cooled, solidified casting removed from the mold shown in FIGS. 7 and 8.

DESCRIPTION OF PREFERRED EMBODIMENT

Referring now to the drawing in detail, FIG. 1 diagrams the process of the present invention, generally referred to by reference numeral 10, through which a composite metallic product 12 is fabricated with reinforcement therein in the form of alumina tiles 14 selected from a commercially available type designated AD-96 having a normal compositional content of 96% $Al_2O_3$. Such tiles undergo silver coating 20 before being framed by aluminum shoes 16 to form tile-loaded jigs 18 as denoted in FIG. 1 and shown in FIGS. 2–5. In order to minimize aluminum oxidation and enhance wetting and bonding of molten aluminum with the tiles 14 and jig framing shoes 16, respectively, the silver coating 20 is applied in accordance with a process disclosed for example in U.S. Pat. No. 4,958,763 to Divecha et al., involving use of a saturated solution of 35% silver nitrate in water, within which the tile-loaded jigs 18 undergo 12 cycles of solution soaking while heated to a temperature of about 475° C. to achieve a coating thickness of 12 mills. Such coated, tile-loaded jigs are then slowly heated by passage through a furnace at a rate of 6 inches per 15 minutes to forestall cracking during subsequent stages of the process 10. A tunnel type furnace fitted with a continuous metal draw belt was utilized to perform such heating in a stage 22 as diagrammed in FIG. 1.

Centrifugal casting 24, as diagrammed in FIG. 1, is preceded by supply of the silver coated, tile-loaded jigs from the furnace heating stage 22 to a casting mold 26 that is coated with a 0.01 inch thick layer of aluminum oxide as a release agent to facilitate subsequent removal of the casting product form such mold. The mold is then heated to a temperature of 540–560° C. by gas heating 28. A predetermined quantity of aluminum alloy melt 30, heated to a liquid state in an induction furnace, is then poured into the heated mold 26 after its transfer to a vertical caster within which the centrifugal casting operation 24 is performed. The liquid aluminum alloy in the mold undergoing rotation within the caster is at a temperature of 1350–1400° F. while being rotated at a speed of 450 RPM for a duration of one minute, terminated by solidification of the casting. The solidified casting then undergoes cooling 32 before mold removal 34 to expose the composite armor product 12 as diagrammed in FIG. 1.

The arrangement and selection of material for the tile-loaded jigs 18 is an important feature of the composite armor fabricating process 10 hereinbefore described because of its tile positioning attribute and reaction to the molten metal surrounding it in the mold. As shown in FIGS. 2, 3, 4 and 5, each alumina tile 14 is of square shape and uniform thickness framed between one pair of parallel shoes 36 spaced from each other by a second pair of parallel shoes 38. Each of the tile framing shoes 36 and 38 are respectively formed with grooves 40 and 42 for receiving the side edge portions of the tile 14. Each of the side edge portions of the tile 14 received in the grooves 42 of shoes 38 have a steel arrester lock pin 44 extending therethrough as shown in FIGS. 3 and 5. Such pins 44 also extend through aligned bores 46 in the shoes 36 as shown in FIG. 3 for projection from the shoes 36 in order to maintain positioning of the jig 18 within the aluminum oxide coated casting mold 26, as hereinafter explained.

As shown in FIGS. 6, 7 and 8, the internally coated casting mold 26 is of a split construction having a lower graphite section 48 aligned with an upper graphite section 50 along a die parting line 51 to enclose a casting chamber 52 into which the aforementioned aluminum alloy melt 30 is poured through an inlet passage 54 in the upper split mold section 50 as shown in FIG. 7. A plurality of jigs 16 having silver coatings 56 thereon are shown within the mold chamber 50 locked in position by their projecting lock pins

44. Accordingly, a plurality of such silver coated jigs 16 loaded with an alumina tiles 14 became effectively embodied in the cast aluminum alloy block 56 of the composite metal product 12 as shown in FIG. 9, extracted after solidification and cooling from the mold. Such product 12 because of its rapid casting in accordance with the fabrication process 10 reveals almost no porosity, good interface wetting between the aluminum alloy block 56 and the alumina tiles 14, without any parting or cracking in the region of such interface.

Obviously, other modifications and variations of the present invention may be possible in light of the foregoing teachings. It is therefore to be understood that within the scope of the appended claims the invention may be practiced otherwise than as specifically described.

What is claimed is:

1. A method of fabricating a composite product made from metallic material reinforced by tiles embodied therein, involving the steps of: positioning the tiles within a mold within which centrifugal casting of said metallic material about the tiles is performed to produce said product, the improvement residing in additional steps of: assembling each of the tiles within metallic framing grooves prior to said positioning thereof within the mold; and heating the metallic material to a molten state for deposit into the mold after said positioning therein of the tiles assembled within the metallic framing which is bonded to the metallic material by said casting thereof wherein said centrifugal casting is performed by rotation of the mold at 450 RPM with the metallic material in the molten state at a temperature of 1350–1400° F.

2. The method as defined in claim 1, further including the step of: coating the tiles and the metallic framing within the mold to prevent oxidation of the framing by transfer of heat thereto from the deposited material in the molten state and enhance bonding thereof to the tiles and the framing respectively.

3. The method as defined in claim 2, wherein said step of coating involves formation of a layer of silver on the tiles and the framing within the mold.

4. The method as defined in claim 3, further including the step of; coating the mold with a release agent to enhance removal of the reinforced metallic material from the mold after said casting therein.

5. The method as defined in claim 4, wherein said release agent is aluminum oxide.

6. The method as defined in claim 1, further including the step of, coating the mold with a release agent to enhance removal of the reinforced metallic material from the mold after said casting therein.

7. The method as defined in claim 6, wherein said release agent is aluminum oxide.

* * * * *